US008082893B2

(12) United States Patent
Sugiura

(10) Patent No.: US 8,082,893 B2
(45) Date of Patent: Dec. 27, 2011

(54) COOLING SYSTEM OF INTERNAL COMBUSTION ENGINE

(75) Inventor: Hiroyuki Sugiura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 428 days.

(21) Appl. No.: 12/393,600

(22) Filed: Feb. 26, 2009

(65) Prior Publication Data

US 2009/0241864 A1 Oct. 1, 2009

(30) Foreign Application Priority Data

Mar. 27, 2008 (JP) ..... 2008-084704

(51) Int. Cl.
*F01P 7/16* (2006.01)

(52) U.S. Cl. ..... 123/41.1; 123/196 R; 123/41.82 R

(58) Field of Classification Search ..... 123/41.1, 123/41.31, 41.33, 41.44, 41.02, 41.08, 41.09, 123/196 R, 41.82 R; 184/104.3
See application file for complete search history.

(56) References Cited

U.S. PATENT DOCUMENTS

| | | | | |
|---|---|---|---|---|
| 4,708,095 | A * | 11/1987 | Luterek | 123/41.42 |
| 4,854,276 | A * | 8/1989 | Elsbett et al. | 123/196 AB |
| 2002/0014212 | A1 * | 2/2002 | Laimbock | 123/41.33 |
| 2006/0065218 | A1 | 3/2006 | Gokan et al. | |

FOREIGN PATENT DOCUMENTS

| | | | |
|---|---|---|---|
| DE | 3618794 | A1 | 12/1987 |
| DE | 3732164 | A1 | 5/1989 |
| EP | 0239997 | A2 | 10/1987 |
| JP | 59010726 | A * | 1/1984 |
| JP | 2002-213216 | A | 7/2002 |
| JP | 2006-97612 | A | 4/2006 |
| JP | 2007262931 | A * | 10/2007 |

OTHER PUBLICATIONS

European Search Report dated Apr. 24, 2009, issued in corresponding European Patent Application No. 09000234.6.

* cited by examiner

*Primary Examiner* — Michael Cuff
*Assistant Examiner* — Hung Q Nguyen
(74) *Attorney, Agent, or Firm* — Westerman, Hattori, Daniels & Adrian, LLP

(57) ABSTRACT

A cooling system includes: an oil pump for supplying oil under pressure; a cylinder head forming part of a combustion chamber; a cooling portion formed in the cylinder head and adapted to allow circulating oil to cool heat transmitted from the combustion chamber; an oil cooler for cooling oil; and a thermostat for switching between an oil passage routed through the oil cooler and a bypass passage bypassing the oil cooler. The thermostat is disposed in an oil passage between the oil pump and the cooling portion.

3 Claims, 8 Drawing Sheets

COOLING SYSTEM OF INTERNAL COMBUSTION ENGINE

TECHNICAL FIELD

The present invention relates generally to a cooling system of an internal combustion engine, and particularly, to a cooling system of an internal combustion engine for a motorcycle.

BACKGROUND OF THE INVENTION

There is known a traditional cooling system of an internal combustion engine, which includes a generally forwardly inclined cylinder provided in the engine; an oil jacket formed in a cylinder head joined to the cylinder and adapted to cool the cylinder head; an oil cooler disposed forward of the engine; and a thermostat that exercises such control as to introduce or divert oil to or from the oil cooler. In addition, the thermostat is directly attached to the front of the crankcase. Oil having passed through the oil jacket is discharged to the front of the cylinder head, i.e., of the engine. The oil discharged forward of the engine is passed through the thermostat and then delivered to the oil cooler or to a bypass passage bypassing the oil cooler depending on temperature conditions (See e.g. Japanese Patent Laid-open No. 2006-97612).

However, in the cooling system of the internal combustion engine described in Japanese Patent Laid-open No. 2006-97612, although the oil temperature is controlled by the thermostat, a route between the downstream of the thermostat and a cooling portion is long. Thus, it is difficult to supply the oil thus temperature-controlled to the cooling portions. In addition, the oil that has cooled the cylinder head is allowed to pass through the oil cooler and then is returned to the oil pan. Thereafter, oil is again supplied by an oil pump to the cooling portion of the cylinder head; therefore, the oil cooled by the oil cooler is heated by the engine before the oil reaches the cooling portions again. Thus, it is difficult to improve the cooling efficiency of the cooling portion.

SUMMARY OF THE INVENTION

The present invention has been made to eliminate such a disadvantage and aims to provide a cooling system of an internal combustion engine that can improve the cooling efficiency of a cooling portion.

To achieve the above object, the invention is characterized in that in a cooling system of an internal combustion engine, includes an oil pump for supplying oil under pressure; a cylinder head forming part of a combustion chamber; a cooling portion formed in the cylinder head and adapted to allow circulating oil to cool heat transmitted from the combustion chamber; an oil cooler for cooling oil; and a thermostat for switching oil circulation between an oil passage routed through the oil cooler and a bypass passage bypassing the oil cooler. The thermostat is disposed in an oil passage between the oil pump and the cooling portion.

The invention is further characterized in that, in addition to the configuration of the invention recited above, a return oil passage of the oil cooler is connected to an oil passage between the thermostat and the cooling portion.

The invention is further characterized, in addition to the configuration of the invention recited above, by further including a lubricating system oil passage adapted to supply oil to a lubrication portion of the internal combustion engine; a cooling system oil passage adapted to supply oil to the cooling portion; and an oil pan for storing oil; and in that the lubricating system oil passage and the cooling system oil passage are provided independently of each other so as to use the oil pan as a source.

The invention is further characterized in that, in addition to the configuration of the invention recited above, the internal combustion engine is an internal combustion engine for a small-sized vehicle, and includes a transmission chamber provided on the rear side of a cylinder block with respect to a traveling direction of the vehicle, and the thermostat is disposed rearward of the cylinder block and above the transmission chamber.

The invention is further characterized in that, in addition to the configuration of the invention recited above, the cylinder block and the cylinder head are formed with a bulging portion as part of a cam chain chamber at a cylinder-arrangement direction central portion, and the thermostat is provided adjacent to the bulging portion.

According to the cooling system of an internal combustion engine, since the thermostat is disposed in the oil passage between the oil pump and the cooling portion and provided upstream of the cooling portion, the temperature of oil supplied to the cooling portion can be accurately controlled to thereby improve the cooling efficiency of the cooling portion.

According to the cooling system of an internal combustion engine, since the return oil passage of the oil cooler is connected to the oil passage between the thermostat and the cooling portion, oil cooled by the oil cooler can directly be supplied to the cooling portion. Thus, oil can be prevented from being heated by other portions of the internal combustion engine to thereby further improve the cooling efficiency of the cooling portion.

According to the cooling system of an internal combustion engine, the cooling system further includes the lubricating system oil passage adapted to supply oil to a lubrication portion of the internal combustion engine; the cooling system oil passage adapted to supply oil to the cooling portion; and the oil pan for storing oil; and the lubricating system oil passage and the cooling system oil passage are provided independently of each other with the oil pan used as a source. Therefore, the oil cooler is disposed in the cooling system oil passage where oil largely rises in temperature. Thus, the cooling efficiency of the cooling portion can further be improved.

According to the cooling system of an internal combustion engine, the internal combustion engine is an internal combustion engine for a small-sized vehicle, and includes the transmission chamber provided on the rear side of the cylinder block with respect to a traveling direction of the vehicle, and the thermostat is disposed rearward of the cylinder block and above the transmission chamber. Therefore, exposure of the thermostat can be prevented when the internal combustion engine is viewed from the front of the vehicle, thereby improving external appearance. In addition, since it is not necessary to additionally prepare a member for protecting the thermostat, the number of component parts can be reduced to reduce the weight of the internal combustion engine as compared with the case where the thermostat is disposed forward of the internal combustion engine.

According to the cooling system of an internal combustion engine, the cylinder block and the cylinder head are formed with the bulging portion as part of the cam chain chamber at a cylinder-arrangement direction central portion, and the thermostat is provided adjacent to the bulging portion. Therefore, the bulging portions of the internal combustion engine can be collected to thereby improve the flexibility of arrangement of other auxiliary machinery or peripheral structures of the engine.

BRIEF DESCRIPTION OF THE DRAWINGS

The advantages of the invention will become apparent in the following description taken in conjunction with the drawings, wherein.

DETAILED DESCRIPTION OF THE INVENTION

Figure 1:
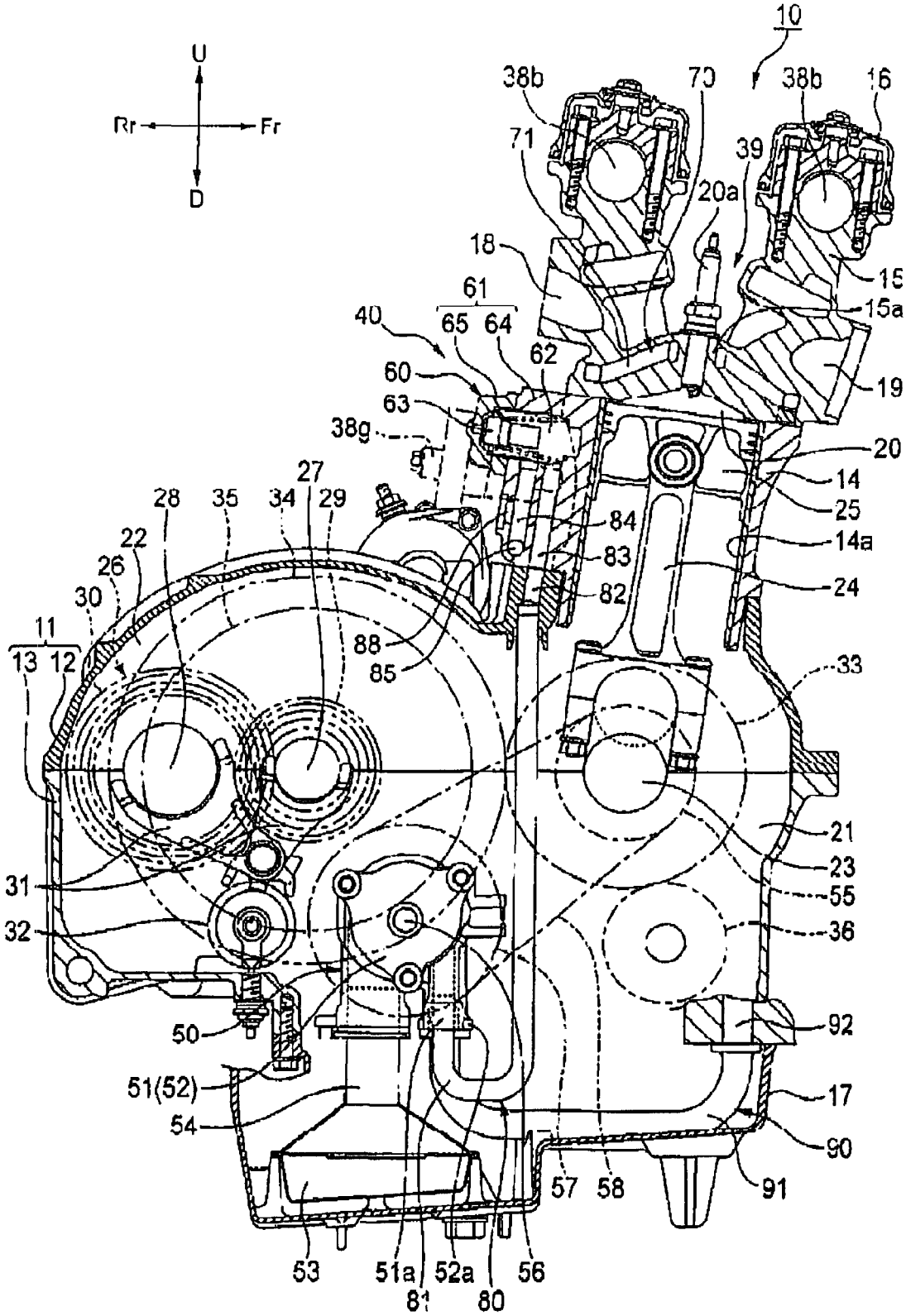
FIG. 1 is a partial cutout right lateral view explaining an embodiment of a cooling system of an internal combustion engine according to the present invention.

An embodiment of a cooling system of an internal combustion engine according to the present invention will hereinafter be described in detail with reference to the accompanying drawings. Incidentally, the internal combustion engine of the present embodiment is mounted on a motorcycle (not shown). In the following description, the front and back or rear, the left and right, and upside and downside are based on the direction a rider faces. In the drawings, the front, back or rear, left, right, upside and downside of a motorcycle are denoted with Fr, Rr, L, R, U and D, respectively.

The internal combustion engine 10 of the present embodiment is an in-line four-cylinder engine as shown in FIG. 1. An outer shell of the engine mainly includes a crankcase 11 composed of an upper crankcase 12 and a lower crankcase 13; a cylinder block 14 mounted to the front upper end of the crankcase 11; a cylinder head 15 mounted to the upper end of the cylinder block 14; a cylinder head cover 16 covering the upper opening of the cylinder head 15; an oil pan 17 covering the lower end opening of the crankcase 11 and storing oil; and a crankcase side cover (not shown) covering the openings of the left and right lateral surfaces of the crankcase 11.

The cylinder head 15 is formed at a rear surface with an intake port 18 joined with a throttle body (not shown) and at a front surface with an exhaust port 19 joined with an exhaust pipe (not shown). A combustion chamber 20 is formed below the lower surface of the cylinder head 15. A spark plug 20*a* is attached to a plug seat 15*a* of the cylinder head 15 so as to face the combustion chamber 20.

As shown in FIG. 1, the crankcase 11 includes a crank chamber 21 at a front portion and a transmission chamber 22 at a rear portion. A crankshaft 23 is rotatably journaled inside the crank chamber 21 via bearings (not shown) at a mating surface between the upper crankcase 12 and the lower crankcase 13. A piston 25 is connected to the crankshaft 23 via a connecting rod 24. The piston 25 is reciprocated in a cylinder axial direction in each of cylinder bores 14*a* of in-line four cylinders included in the cylinder block 14. In the embodiment, the cylinder axis is arranged to be inclined forwardly in a vehicle traveling direction.

The transmission chamber 22 is disposed on the rear side of the cylinder block 14. A constant-mesh type transmission 26 is housed in the transmission chamber 22. This transmission 26 includes a main shaft 27, a countershaft 28, a plurality of drive gears 29, a plurality of driven gears 30, a plurality of shift forks 31 and a shift drum 32. The main shaft 27 and countershaft 28 are rotatably journaled via bearings (not shown) provided at a mating surface between the upper crankcase 12 and the lower crankcase 13. The drive gears 29 are provided on the main shaft 27. The driven gears 30 are provided on the countershaft 28 so as to mesh with the drive gears 29. The shift forks 31 are engaged with the drive gears 29 and with the driven gears 30. The shift drum 32 is turnably carried by the crankcase 11 so as to slidably move the shift forks 31 in an axial direction.

The rotational drive force of the crankshaft 23 is transmitted to the transmission 26 via a primary drive gear 33 provided on the crankshaft 23, a primary driven gear 34 provided on the main shaft 27 so as to mesh with the primary drive gear 33, and a clutch device 35 provided on the main shaft 27. A balancer gear 36 meshed with the primary drive gear 33 is housed in the crank chamber 21.

As shown in FIGS. 2 and 5 through 7, a cam chain chamber 37 is formed in the cylinder block 14 and cylinder head 15 at a cylinder-arrangement direction central portion so as to house a drive transmission device 38 of a valve train provided in the cylinder head 15. This cam chain chamber 37 communicates with the crank chamber 21.

Figure 2:
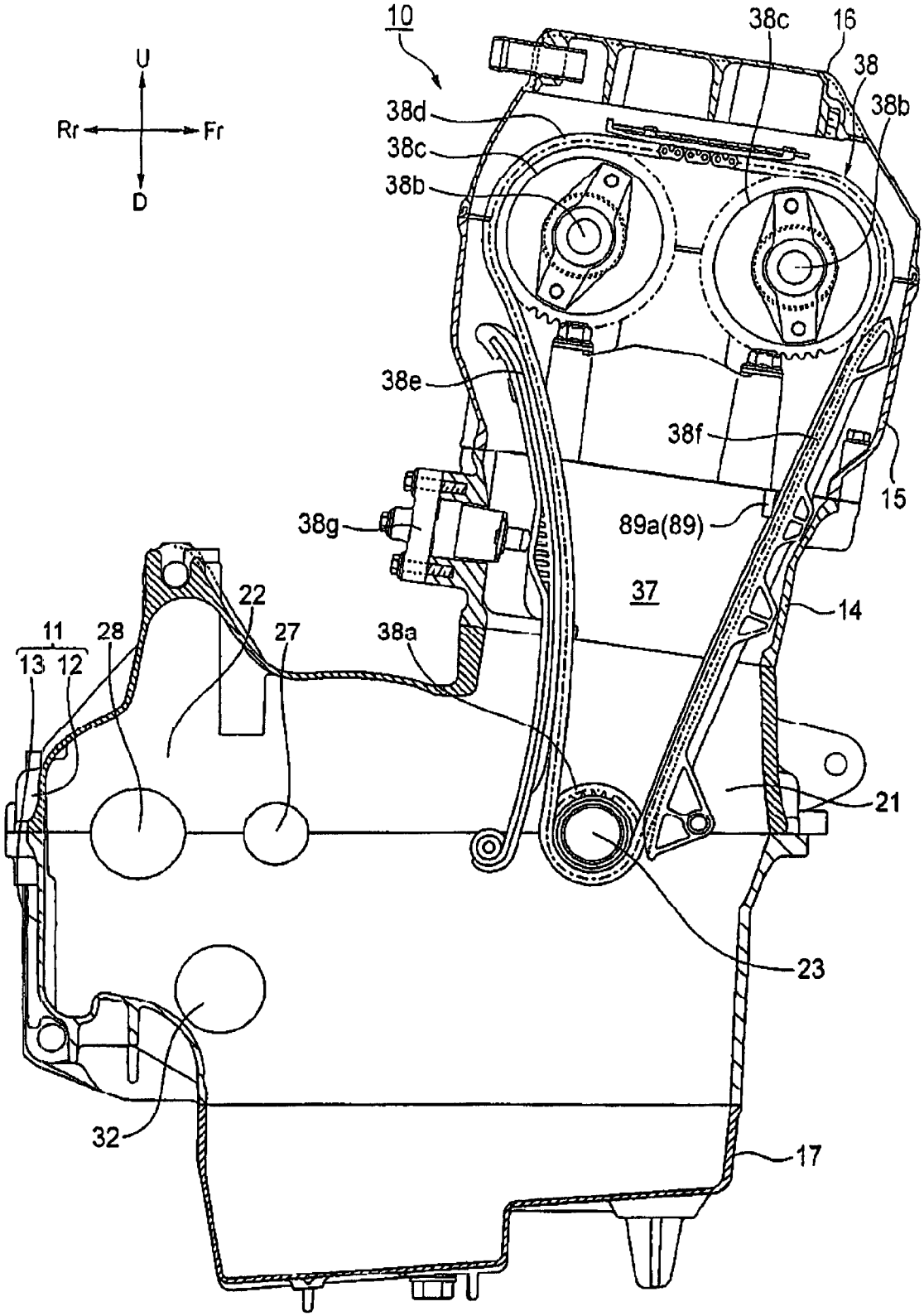
FIG. 2 is a partial cutout right lateral view explaining a drive transmission device of a valve train of the internal combustion engine according to the invention.

As shown in FIG. 2, the drive transmission device 38 includes a cam drive gear 38*a* provided on the crankshaft 23; cam driven gears 38*c*, 38*c* provided on two respective cam shafts 38*b*, 38*b* rotatably journaled by the cylinder head 15; and a cam chain 38*d* wound around the cam drive gear 38*a* and around the cam driven gears 38*c*, 38*c*. The drive transmission device 38 further includes a chain tensioner 38*e* in contact with an upward outer circumferential surface of the cam chain 38*d*; a chain guide 38*f* in contact with a downward outer circumferential surface of the cam chain 38*d*; and a tensioner lifter 38*g* adapted to press the chain tensioner 38*e* from the rear side thereof and apply appropriate tensile force to the cam chain 38*d*.

The internal combustion engine 10 of the embodiment is provided with a cooling system 40 for cooling the engine 10. As shown in FIGS. 1 through 8, the cooling system 40 mainly includes an oil pump unit 50, a thermostat 60, an oil jacket (a cooling portion) 70, an oil cooler 41 (see FIG. 8), and a cooling system oil passage 80. The oil pump unit 50 sucks oil in the oil pan 17 and supplies it under pressure therefrom. The thermostat 60 is disposed on the rear surface portion of the cylinder block 14. The oil jacket 70 is formed inside the cylinder head 15 to allow circulating oil to cool heat transmitted from the combustion chamber 20. The oil cooler 41 is adapted to cool oil. The cooling system oil passage 80 interconnects the oil pump unit 50, the thermostat 60, the oil jacket 70, the oil cooler 41 and the crank chamber 21 for communication with one another.

As shown in FIG. 1, the oil pump unit 50 is mounted to the right lateral surface of the lower crankcase 13. In addition, the oil pump unit 50 includes a cooling oil pump 51 and a lubricating oil pump 52 horizontally juxtaposed to each other; a strainer 53 disposed close to the bottom of the oil pan 17; and an oil suction pipe 54 connecting each of the cooling oil pump 51 and the lubricating oil pump 52 with the strainer 53.

The oil pump unit 50 is driven by the rotational driving force of the crankshaft 23 transmitted via a pump drive gear 55, a pump driven gear 57, and a pump chain 58. The pump drive gear 55 is provided on the crankshaft 23. The pump driven gear 57 is provided on a pump shaft 56 shared by the cooling oil pump 51 and the lubricating oil pump 52. The pump chain 58 is spanned between and wound around the pump drive gear 55 and the pump driven gear 57.

The thermostat 60 includes a thermostat case 61 disposed on the rear surface portion of the cylinder block 14 and a thermostat valve 63 housed in a thermostat chamber 62 formed in the thermostat case 61. The thermostat case 61 has a case main body 64 formed integrally with the cylinder block 14 and a lid portion 65 closing an upper end opening of the case body 64. The thermostat 60 switches between opening and closing of an oil discharge side connecting portion 87 which is an oil passage routed through an oil cooler 41 (described later) and opening and closing of a bypass passage 84 bypassing the oil cooler 41, in response to the temperature of oil flowing into the thermostat chamber 62. In the present embodiment, the thermostat 60 is disposed rearward of the cylinder block 14 and above the transmission chamber 22.

Figure 7:
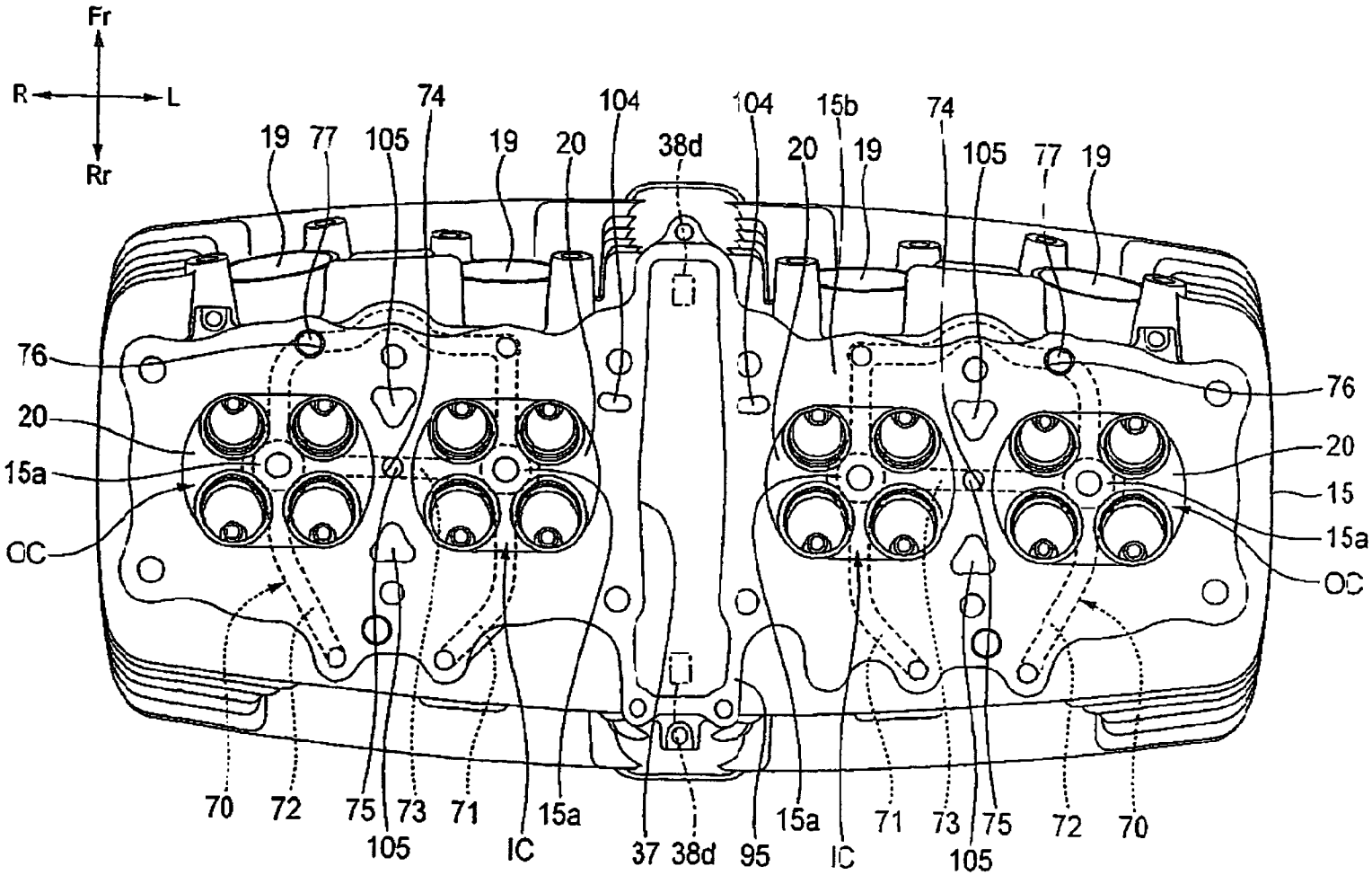
FIG. 7 is a bottom view of a cylinder head shown in FIG. 1.
Figure 8:
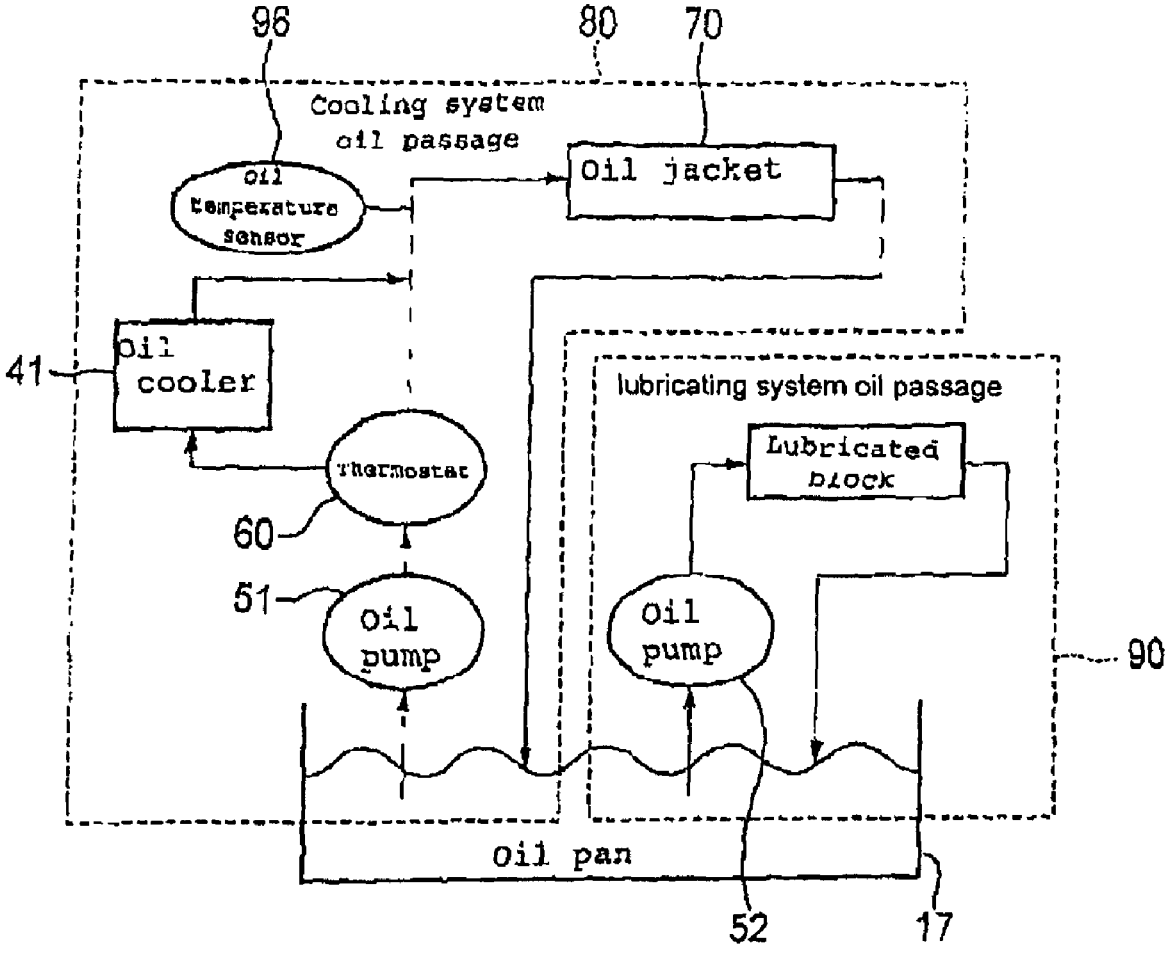
FIG. 8 is a schematic diagram explaining an oil circulation circuit of the cooling system of the internal combustion engine according to the present invention.

Referring to FIG. 7, the oil jacket 70 includes first jacket passages 71, 71, second jacket passages 72, 72, and jacket bypass passages 73, 73. The first jacket passages 71, 71 are respectively formed to be routed through the peripheries of plug seats 15*a* of two inside cylinders IC, IC from the sides of the intake ports 18 of the cylinder head 15 toward the exhaust ports 19. The second jacket passages 72, 72 are respectively formed to be routed through the peripheries of plug seats 15*a* of two outside cylinders OC, OC from the sides of the intake ports 18 of the cylinder head 15 toward the exhaust ports 19. Then, the second jacket passages 72, 72 merge at downstream ends with the corresponding downstream ends of the first jacket passages 71. The jacket bypass passages 73, 73 each allow the first jacket passage 71 and the second jacket passage 72 to communicate with each other on the periphery of the plug seat 15*a*.

A sand-stripping hole 74 is formed in the lower surface of an almost-central portion of the jacket bypass passage 73 included in the cylinder head 15 so as to draw collapsing sand of a core used to form the oil jacket 70. A sand-drawing plug 75 is fitted into the sand-stripping hole 74 so as to project into the jacket bypass passage 73.

As shown in FIGS. 1 through 8, the cooling system oil passage 80 includes a cooling oil supply pipe 81, a first oil supply passage 82, a second oil supply passage 83, a bypass passage 84, an oil distribution passage 85, oil branch passages 86, 86, 86, 86, an oil discharge side connecting portion 87, an oil return side connecting portion 88, and an oil discharge passage (an oil return passage) 89. The cooling oil supply pipe 81 is connected to a discharge port 51*a* of the cooling oil pump 51. The first oil supply passage 82 is formed at the front upper end of the upper crankcase 12 so as to extend upward and connect with the cooling oil supply pipe 81. The second oil supply passage 83 is formed in the rear surface portion of the cylinder block 14 so as to extend upward and communicate at its lower end with the first block oil supply passage 82 and at its upper end with the thermostat chamber 62. The bypass passage 84 is formed in the rear surface portion of the cylinder block 14 to extend downward and communicate with the thermostat chamber 62 at its upper end. The oil distribution passage 85 is formed in the rear surface portion of the cylinder block 14 to extend along the cylinder-arrangement direction and communicate with the lower end of the bypass passage 84. The oil branch passages 86, 86, 86, 86 are formed in the rear surface portion of the cylinder block 14 so as to extend upward and communicate with the oil distribution passage 85 at its lower end and with the corresponding respective upstream ends of the first and second jacket passages 71, 71, 72, 72 at its upper end. The oil discharge side connecting portion 87 is formed in the lid portion 65 of the thermostat case 61 to communicate with the thermostat chamber 62 and connect with a pipe led to the oil cooler 41. The oil return side connecting portion 88 is formed in the rear surface portion of the cylinder block 14 so as to connect with a return pipe led from the oil cooler 41 and communicate with the bypass passage 84. The oil discharge passage (the oil return passage) 89 is formed in the cylinder block 14, adapted to draw out oil from the oil jacket 70 and formed with a discharge port 89*a* opening in the cam chain chamber 37.

Figure 5:
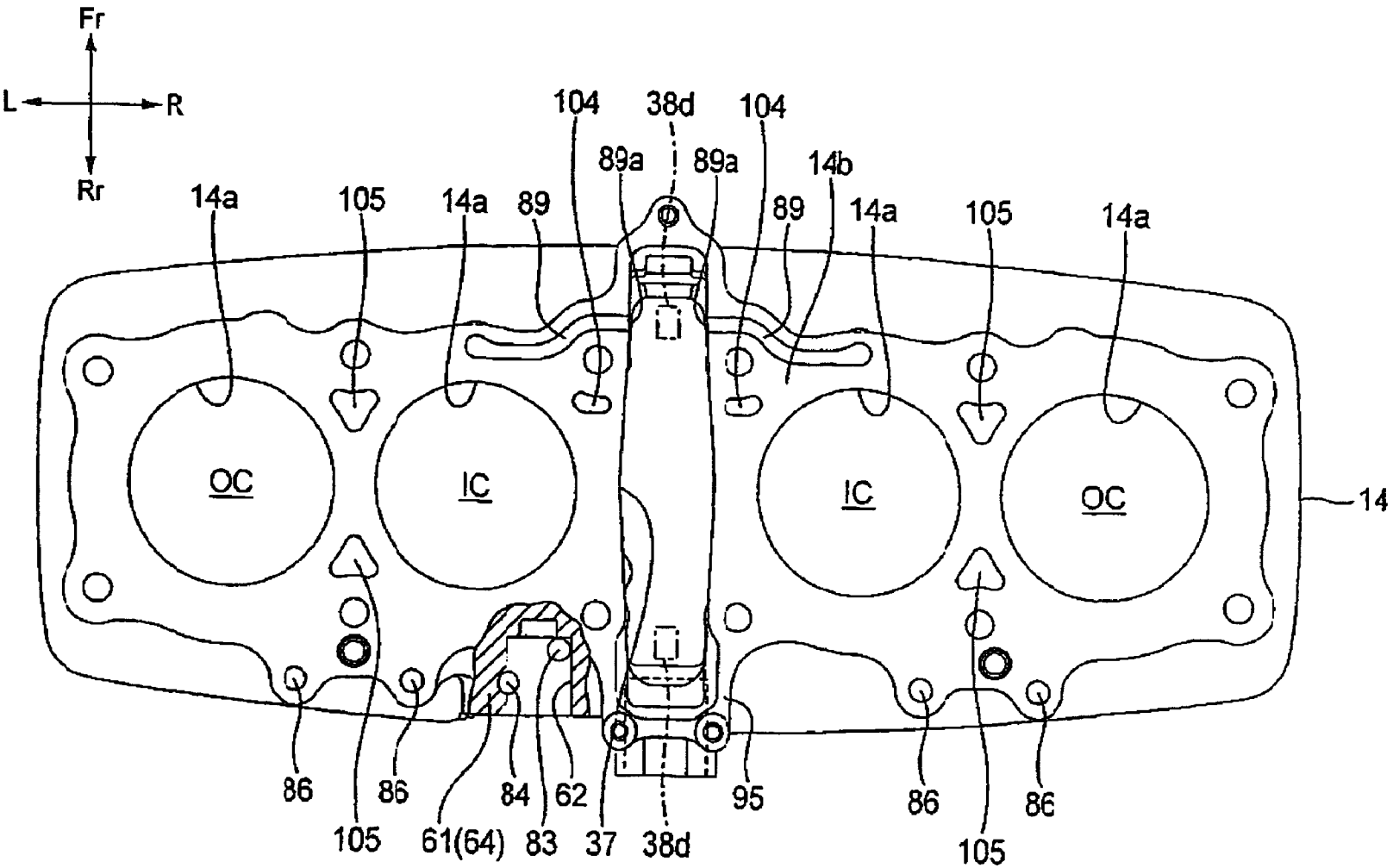
FIG. 5 is a plan view of the cylinder block shown in FIG. 4.

In the embodiment, as shown in FIG. 5, the oil discharge passage 89 communicates with the downstream end of the first jacket passage 71 and functions to return oil from the oil jacket 70 to the oil pan 17 which is the oil supply side. In addition, the oil discharge passage 89 is formed in the upper surface of the cylinder block 14 and close to the inside cylinder IC and to the exhaust port 19 so as to extend toward the cam chain chamber 37 like a groove. In this way, the exhaust ports 19, 19 of the inside cylinders IC, IC can efficiently be cooled.

In the embodiment, as shown in FIGS. 2 and 5, the discharge ports 89*a* of the oil discharge passages 89 are each provided to face the downward (the front of FIG. 2) lateral surface of the cam chain 38*d* of the drive transmission device 38. Thus, the oil discharged from the discharge port 89*a* is transferred to the downside of the internal combustion engine 10 by the cam chain 38*d* and is returned into the oil pan 17.

In the embodiment, as shown in FIG. 2, the chain guide 38*f* is provided to extend downward from the discharge port 89*a*. Thus, the oil discharged from the discharge port 89*a* hits the cam chain 38*d*, and then is led downward of the internal combustion engine 10 by the chain guide 38*f* and is returned into the oil pan 17.

In the embodiment, as shown in FIG. 5, the oil discharge passage 89 is formed like a groove in the mating surface 14*b* between the cylinder block 14 and the cylinder head 15 to extend from the downstream end of the first jacket passage 71 toward the cam chain chamber 37. The oil discharge passage 89 communicates with the downstream end of the first jacket passages 71 at its upstream end. Thus, oil is transferred from the downstream end of the first jacket passage 71 to the upstream end of the oil discharge passage 89.

In the embodiment, as shown in FIGS. 2 and 5, the cylinder axis of the cylinder bore 14*a* is forwardly inclined along the downward side of the cam chain 38*d*. The oil discharge passage 89 is formed to communicate with the discharge port 89*a* from the inclined-direction upside toward the inclined-direction downside.

As shown in FIG. 1, a lubricating system oil passage 90 adapted to supply oil to lubrication portions (various rotating shafts, gears, etc.) of the internal combustion engine 10 is connected to the discharge port 52*a* of the lubricating oil pump 52. The lubricating system oil passage 90 includes a lubricating oil supply pipe 91 connected to the discharge port 52*a* of the lubricating oil pump 52; and a lubricating oil passage 92 adapted to supply oil to the lubrication portions of the internal combustion engine 10. In this way, the cooling system oil passage 80 and the lubricating system oil passage 90 are provided independently of each other so as to extend from the oil pan 17 as a source.

Figure 3:
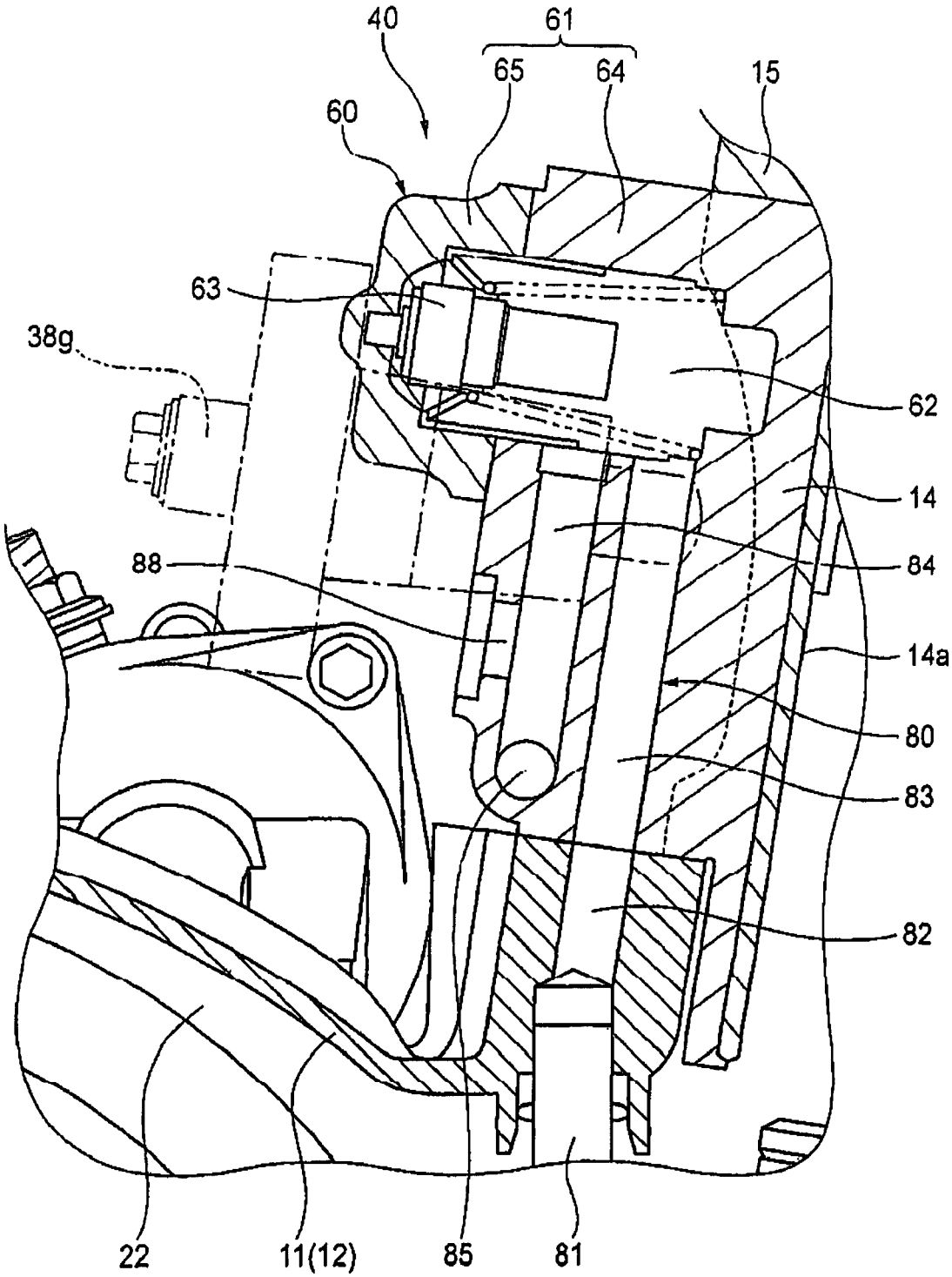
FIG. 3 is an enlarged right lateral view illustrating the periphery of a thermostat shown in FIG. 1.

In the embodiment, as shown in FIG. 3, the thermostat valve 63 of the thermostat 60 is disposed in the thermostat chamber 62 which is an oil passage between the cooling oil pump 51 and the oil jacket 70.

In the embodiment, as shown in FIG. 3, the oil return side connecting portion 88 which is a return oil passage of the oil cooler 41 is connected to the bypass passage 84 which is an oil passage between the thermostat chamber 62 of the thermostat 60 and the oil jacket 70.

In the embodiment, as shown in FIGS. 4 through 7, a bulging portion 95 resulting from the cam chain chamber 37 is formed at the cylinder-arrangement direction central portion of the rear surface of the cylinder block 14 and cylinder head 15. The thermostat 60 is provided adjacent to the left of the bulging portion 95.

In the embodiment, as shown in FIGS. 2 and 3, the tensioner lifter 38*g* for applying adequate tensile force to the cam chain 38*d* is attached to the bulging portion 95 of the cylinder block 14 at the horizontally central position thereof. The thermostat 60 is disposed at a position overlapping the tensioner lifter 38*g* as viewed from the side.

In the embodiment, as shown in FIG. 7, the following are formed to be exposed to the mating surface 15*b* of the cylinder head 15 with the cylinder block 14: the upstream end of the first jacket passage 71 which is an end of the first jacket passage 71 close to the intake port 18; the downstream end of the first jacket passage 71 which is an end of the first jacket passage 71 close to the exhaust port 19; the upstream end of the second jacket passage 72 which an end of the second jacket passage 72 close to the intake port 18; and an through-hole 76 adapted to receive a leg portion, passed therethrough, of the core used to form the oil jacket 70, the through-hole 76 being an end of the second jacket passage 72 close to the exhaust port 19. The through-hole 76 is closed with a plug member 77.

Figure 4:
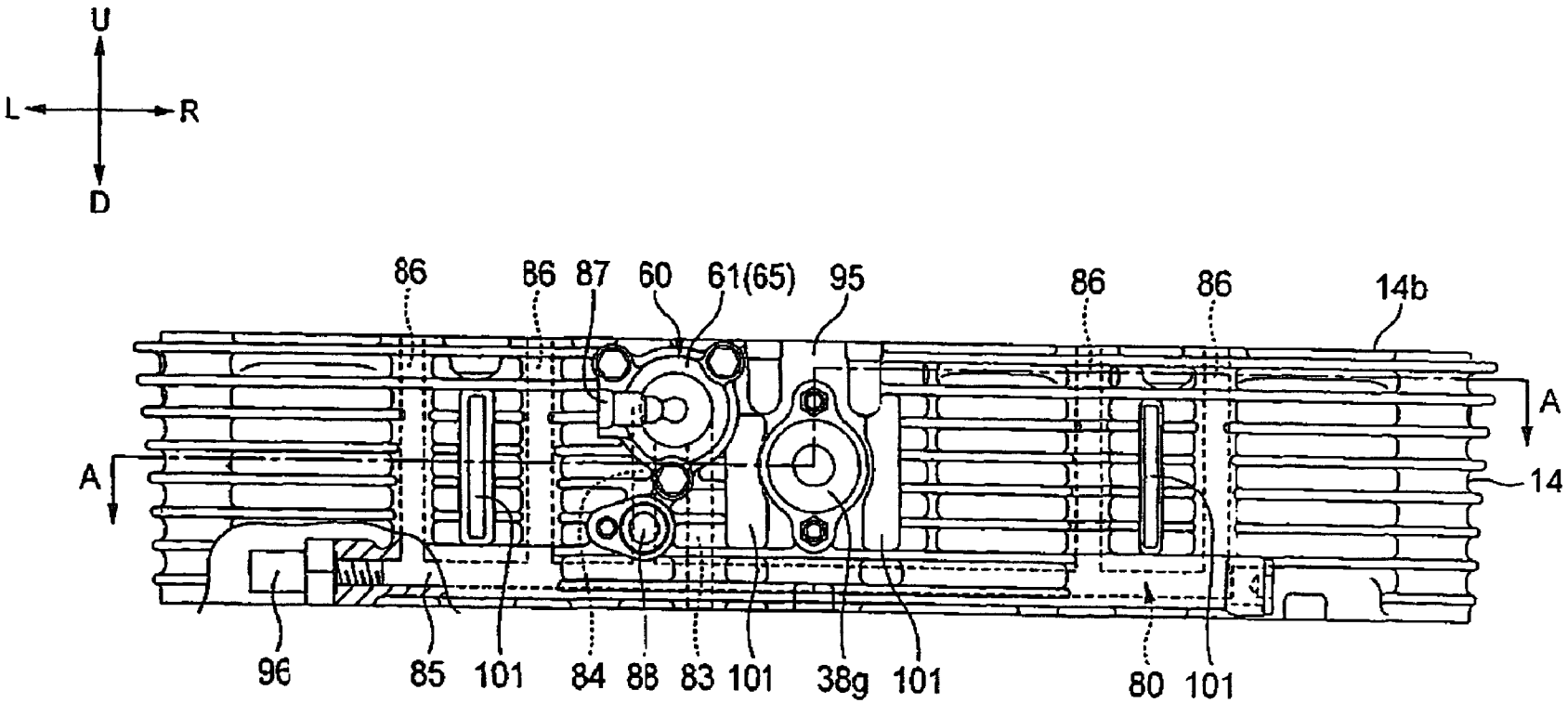
FIG. 4 is a rear view of a cylinder block shown in FIG. 1.

In the embodiment, as shown in FIG. 4, an oil temperature sensor 96 is disposed at the rearward of the cylinder block 14 in the vehicle traveling direction. This oil temperature sensor 96 is attached from the axial direction of the oil distribution passage 85 to a screw portion (not shown) formed on the internal circumference of the left end of the oil distribution passage 85. In addition, the oil temperature sensor 96 is disposed inward of the cylinder-arrangement direction end of the cylinder block 14.

In the embodiment, the oil branch passages 86 are formed in the rear surface portion of the cylinder block 14 so as to be separate from the corresponding cylinder bores 14*a*. Therefore, the oil passing through the oil branch passages 86 can be prevented from being heated by the cylinder bores 14*a* and the like. This makes it possible to improve the cooling efficiency of the oil jacket 70.

Figure 6:
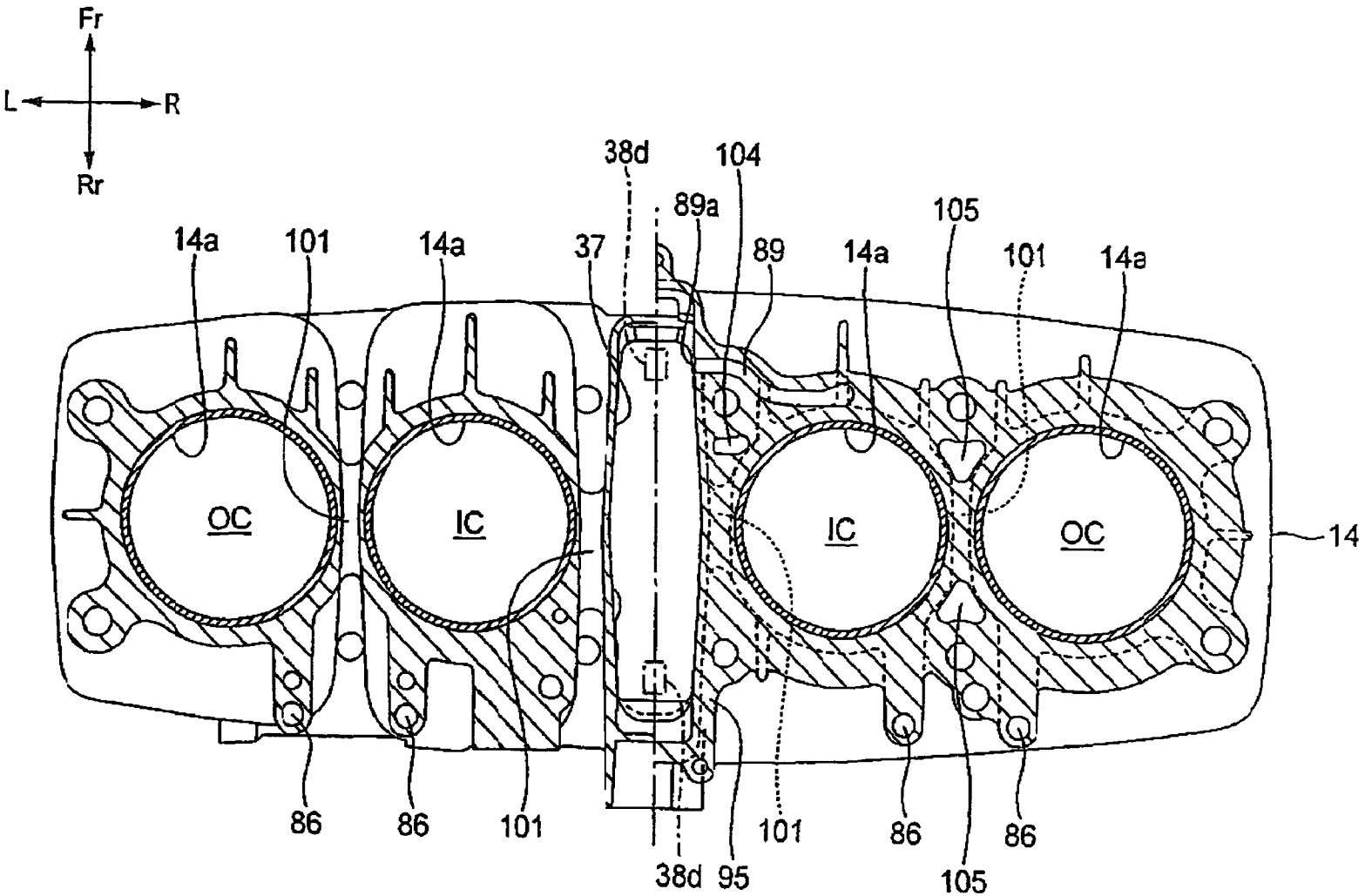
FIG. 6 is a cross-sectional view taken along line A-A of FIG. 4.

In the embodiment, as shown in FIGS. 4 and 6, a cooling air passage 101 is formed between the adjacent cylinder bores 14*a* of the respective cylinders of the cylinder block 14 so as to lead cooling air (running air) from the front to rear of the vehicle. The oil branch passages 86 are formed in the rear surface portion of the cylinder block 14 independently of each other for each cylinder. In addition, the oil branch passages 86 are arranged in the vicinity of the cooling air passages 101, specifically, adjacent to rear left and right portions of the respective external cooling air passages 101. The cooling air that has passed through the cooling air passages 101 smoothly flows along the inside surfaces between the adjacent oil branch passages 86, 86 and is discharged rearward.

In the embodiment, as shown in FIGS. 1 and 5 to 7, a first cooling air introduction passage 104 is formed to longitudinally pass through a portion close to the exhaust port 19 and between the inside cylinder IC and the cam chain chamber 37 of the cylinder block 14 and of the cylinder head 15. This first cooling air introduction passage 104 communicates from the internal cooling air passage 101 to a recessed portion 39 (see FIG. 1) formed above the cylinder head 15. Second cooling air introduction passages 105, 105 are formed to longitudinally pass through respective portions forward of and rearward of a line connecting the respective cylinder centers of the inside cylinder IC and outside cylinder OC included in the cylinder block 14 and in the cylinder head 15. The second cooling air introduction passages 105, 105 communicate from the front and rear ends of the external cooling air passage 101 to the recessed portion 39.

In this way, a portion of cooling air led to the internal cooling air passage 101 is led to the first cooling air introduction passage 104 to cool between the cam chain chamber 37 and the inside cylinder IC and is then led into the recessed portion 39. A portion of cooling air led to the external cooling air passage 101 and a portion of cooling air having passed through the external cooling air passage 101 are led into the second cooling air introduction passages 105, 105 to cool between the inside cylinder IC and outside cylinder OC and are then led into the recessed portion 39. The cooling air led into the recessed portion 39 cools the portions inside the recessed portion 39 and the peripheries of the plug seat 15*a* and then is led to the outside from the opening portion at the cylinder-arrangement direction outer ends of the recessed portion 39.

In the cooling system 40 of the internal combustion engine 10 configured described above, during warm-up operation, the oil supplied under pressure from the cooling oil pump 51, because of the bypass passage 84 opened by the thermostat valve 63, circulates in the following order: the cooling oil supply pipe 81→the first oil supply passage 82→the second oil supply passage 83→the thermostat chamber 62→the bypass passage 84→the oil distribution passage 85→the oil branch passage 86→the oil jacket 70→the oil discharge passage 89→the cam chain chamber 37→the crank chamber 21→the oil pan 17→the cooling oil pump 51.

After the warm-up operation is completed, the oil supplied under pressure from the cooling oil pump 51, because of the oil discharge side connecting portion 87 opened by the thermostat valve 63, circulates in the following order: the cooling oil supply pipe 81→the first oil supply passage 82→the second oil supply passage 83→the thermostat chamber 62→the oil discharge side connecting portion 87→the oil cooler 41→the oil return side connecting portion 88→the bypass passage 84→the oil distribution passage 85→the oil branch passage 86→the oil jacket 70→the oil discharge passage 89→the cam chain chamber 37→the crank chamber 21→the oil pan 17→the cooling oil pump 51.

As described above, according to the cooling system 40 of the internal combustion engine 10 of the present embodiment, the thermostat 60 is disposed in the oil passage between the cooling oil pump 51 and the oil jacket 70 and upstream of the oil jacket 70. Therefore, the temperature of the oil supplied to the oil jacket 70 can appropriately be controlled to thereby improve the cooling efficiency of the oil jacket 70.

According to the cooling system 40 of the internal combustion engine 10 of the present embodiment, the oil return side connecting portion 88 or return oil passage of the oil cooler 41 is connected to the oil passage between the thermostat 60 and the oil jacket 70. Therefore, oil cooled by the oil cooler 41 can directly be supplied to the oil jacket 70. This can prevent oil from being heated by other portions of the internal combustion engine 10 to further improve the cooling efficiency of the oil jacket 70.

The cooling system 40 of the internal combustion engine 10 of the present embodiment includes the lubricating system oil passage 90 adapted to supply oil to the lubrication portions of the engine 10, the cooling system oil passage 80 adapted to supply oil to the oil jacket 70, and the oil pan 17 for storing oil. In addition, the lubricating system oil passage 90 and the cooling system oil passage 80 are provided independently of each other with the oil pan 17 serving as a source. Further, the oil cooler 41 is disposed in the cooling system oil passage 80 where oil largely rises in temperature. Thus, the cooling efficiency of the oil jacket 70 can further be improved.

According to the cooling system 40 of the internal combustion engine 10 of the present embodiment, the internal combustion engine 10 is an internal combustion engine for small-sized vehicles and includes the transmission 20 on the rear side of the cylinder block 14 with respect to the vehicle traveling direction, and the thermostat 60 is disposed rearward of the cylinder block 14 and above the transmission chamber 20. Therefore, the exposure of the thermostat 60 can be suppressed if the internal combustion engine 10 is viewed from the front of the vehicle, thereby improving external appearance. It is not necessary to additionally prepare a member for protecting the thermostat 60 as compared with the case where the thermostat is disposed forward of the internal combustion engine 10. Therefore, the number of component parts can be reduced to thereby reduce the weight of the internal combustion engine 10.

According to the cooling system 40 of the internal combustion engine 10 of the present embodiment, the bulging portion 95 disposed at the cylinder-arrangement directional central portion is formed as the cam chain chamber 37 in the cylinder block 14 and in the cylinder head 15. In addition, the thermostat 60 is provided adjacently to the bulging portion 95. Therefore, the bulging portions of the internal combustion engine 10 can be collected to thereby improve the flexibility of arrangement of other auxiliary machinery or peripheral structures of the internal combustion engine 10.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

I claim:

1. An internal combustion engine, comprising:

an oil pump for supplying oil under pressure;

a cylinder head forming part of a combustion chamber;

a cooling portion formed in said cylinder head and adapted to allow circulating oil to cool heat transmitted from said combustion chamber;

an oil cooler for cooling oil;

an oil passage routed through said oil cooler, a bypass passage bypassing said oil cooler, and a thermostat for switching oil circulation between said oil passage routed through said oil cooler and said bypass passage bypassing said oil cooler;

wherein said thermostat is disposed between said oil pump and said cooling portion, wherein said internal combustion engine includes a transmission chamber provided on the rear side of a cylinder block, with respect to the traveling direction of a vehicle in which said internal combustion engine is mounted, wherein said thermostat is disposed rearward of said cylinder block and above said transmission chamber, wherein said cylinder block and said cylinder head are formed with a bulging portion as part of a cam chain chamber at a cylinder-arrangement direction central portion of said internal combustion engine, wherein said thermostat is provided adjacent to said bulging portion, wherein said thermostat includes a thermostat case disposed on the rear surface portion of said cylinder block and a thermostat valve housed in a thermostat chamber formed in said thermostat case, and wherein said thermostat case has a case main body formed integrally with said cylinder block and a lid portion closing an upper end opening of said case main body.

2. The internal combustion engine according to claim 1, wherein a return oil passage of said oil passage routed through said oil cooler is connected to said bypass passage at a position between said thermostat and said cooling portion.

3. The internal combustion engine according to claim 2, further comprising:

a lubricating system oil passage adapted to supply oil to a lubrication portion of said internal combustion engine;

a cooling system oil passage, comprising said oil passage routed through said oil cooler and said bypass passage, adapted to supply oil to said cooling portion; and an oil pan for storing oil, wherein said lubricating system oil passage and said cooling system oil passage are provided independently of each other and both use said oil pan as a source.

* * * * *